United States Patent [19]

Rolow

[11] Patent Number: 4,577,991

[45] Date of Patent: Mar. 25, 1986

[54] DEPLOYABLE VEHICULAR BARRICADE

[76] Inventor: Willard J. Rolow, Rte. 3, Box 350, Alsea, Oreg. 97324

[21] Appl. No.: 675,726

[22] Filed: Nov. 28, 1984

[51] Int. Cl.[4] ..... E01F 13/00

[52] U.S. Cl. ..... 404/6; 49/49; 49/131

[58] Field of Search ..... 404/6, 9, 10, 11; 49/49, 131; 256/1, 13.1; 43/61; 109/3, 63

[56] References Cited

U.S. PATENT DOCUMENTS

| | | | |
|---|---|---|---|
| 3,086,430 | 4/1963 | Emmel | 404/6 |
| 3,348,331 | 10/1967 | Williams | 43/61 |
| 3,530,775 | 9/1970 | Bowersox | 404/11 |
| 3,963,363 | 6/1976 | Roper | 404/11 |
| 4,113,400 | 9/1978 | Smith | 404/6 |
| 4,354,771 | 10/1982 | Dickinson | 404/6 |
| 4,481,887 | 11/1984 | Urbano | 109/3 |

FOREIGN PATENT DOCUMENTS

| | | | |
|---|---|---|---|
| 2495658 | 6/1982 | France | 49/49 |

*Primary Examiner*—Stephen J. Novosad
*Assistant Examiner*—John F. Letchford
*Attorney, Agent, or Firm*—Chernoff, Vilhauer, McClung, Birdwell & Stenzel

[57] ABSTRACT

A deployable vehicular barricade system includes a plurality of barricade units each having an elongate rigid post slidably received in a below-grade casing. Longitudinally spaced guide plates cooperating between the post and the casing guide the post between an extended position partially projecting from the casing and a retracted position within the casing and also serve to resist vehicular impact to the post in the extended position. A spring in the bottom of the casing and a remotely controlled locking arm and trigger mechanism allow the post to be selectively and instantaneously deployed into the extended position.

9 Claims, 3 Drawing Figures

DEPLOYABLE VEHICULAR BARRICADE

BACKGROUND OF THE INVENTION

This invention relates to vehicular barricades, and particularly to a barricade system having a rugged extensible barricade unit for selectively and effectively preventing vehicular passage along a roadway.

In recent years there has been a dramatic increase in the incidence of terrorist attacks throughout the world. Many of these attacks are directed against governmental officials or governmental installations such as embassies. A popular terrorist tactic is to employ car bombs and suicide drivers to drive an explosive-laden vehicle near the target building and then trigger a massive explosion. Tragic examples of this type of attack are the 1983 and 1984 attacks upon the United States Embassy in Beruit, Lebanon and the 1983 attack upon the United States Marine Headquarters in Beruit.

Of course, these types of attacks could be prevented by prohibiting all vehicular traffic near the installation. Such an approach is considered unacceptable because installations such as embassies should be, and should appear to be, accessible. The image conveyed by an embassy huddled behind a labyrinth of gates and barriers is not an image that most governments desire to project. For this reason a multiplicity of gates and concrete barricades which must be negotiated like a maze are not entirely desirable. Nor, as has been unfortunately demonstrated in Beruit, are they entirely effective against a determined, suicidal terrorist attack.

One solution which would appear to be acceptable and effective would be a barricade system which would be unobtrusive, allowing unimpeded vehicular traffic to the installation, yet capable of being quickly deployed so as to absolutely prevent vehicle passage of the barricade, either by smashing through the barricade, as may be done with a gate, or by circumnavigating the barricade as may be done with cement barriers. An extensible vehicular barricade which could be placed within a roadway is one such device.

Dickinson, U.S. Pat. No. 4,354,771, discloses an above-grade curb barrier for controlling traffic which may be extended to discourage vehicular passage because of possible damage to the vehicle's tires or undercarriage, or retracted to permit vehicular passage over the barrier. Such a device would not be appropriate as an anti-terrorist barricade because it would not present a sufficient obstacle to ensure that all vehicular passage, including heavy trucks and tracked vehicles, would be stopped. Terrorists who are intent upon blowing up themselves and their truck are not likely to be deterred by the prospect of damage to their tires or undercarriage. The curb barrier is also sufficiently complex to be too expensive for such a use, especially if it were upscaled to increase the size and strength of the device.

Pop-up traffic control devices such as Roper, U.S. Pat. No. 3,963,363, Emmel, U.S. Pat. No. 3,086,430, and Bowersox, U.S. Pat. No. 3,530,775, which are installed below grade and pop up in the roadway to guide traffic do not disclose any structure or mechanism for resisting vehicular impact and preventing vehicular passage; to the contrary, they all disclose devices which are designed to yield to vehicular impact.

SUMMARY OF THE INVENTION

The present invention addresses the problems set forth above by providing a rugged extensible barricade unit which when retracted, is barely noticeable and permits the unimpeded flow of traffic over the barricade, but when extended, absolutely prohibits the passage of vehicular traffic.

The invention employs a rigid post which is slidably received in a casing positioned below grade in a roadway. The post has a retracted position within the casing and an extended position wherein a portion of the post extends out of the casing and up into the roadway. A spring and trigger mechanism are employed to selectively propel the post rapidly from the retracted position to the extended position. A pair of spaced-apart guide plates cooperate between the post and casing to guide the movement of the post within the casing and to resist impact to the extended post. An array of barricade units such as described herein may be installed in a roadway to prevent vehicular passage along the roadway. A plurality of such arrays may be employed to trap and immobilize the terrorist's vehicle.

Accordingly, it is a principal object of the present invention to provide an extensible vehicular barricade.

It is a further object of the present invention to provide such a barricade unit which when extended is capable of preventing vehicular passage proximate the barricade unit.

It is a further object of the present invention to provide such a barricade unit which when retracted is unobtrusive and does not impede vehicular flow.

It is a further object of the present invention to provide such a barricade unit which can resist enormous impact.

It is a further object of the present invention to provide a barricade system employing a plurality of such barricade units for selectively preventing vehicular passage along a roadway.

It is a further object of the present invention to provide such a barricade system which could trap and immobilize a terrorist's vehicle-bomb.

The foregoing and other objectives, features and advantages of the present invention will be more readily understood upon consideration of the following detailed description of the invention taken in conjunction with the accompanying drawings.

A further objective is the concealment in concrete incasement, that damage would be less likely from an explosion and also the re-opening of traffic as plates could cover the opening until repairs are made and device re-set.

DETAILED DESCRIPTION OF THE INVENTION

Figure 2:
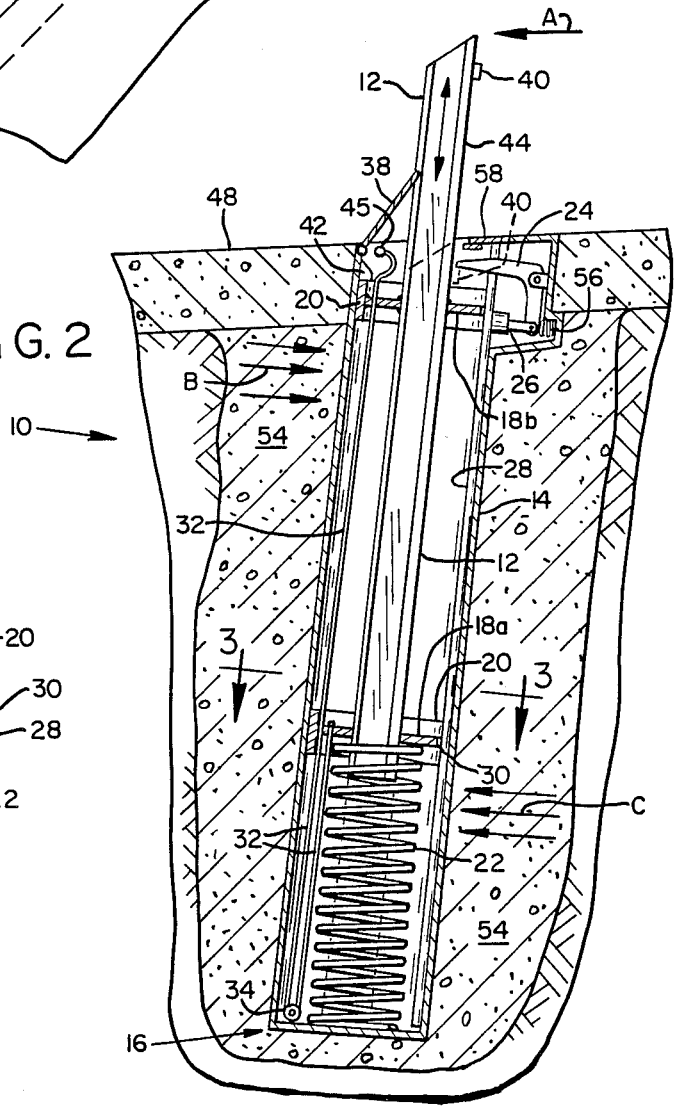
FIG. 2 is a sectional elevational view of an installed barricade unit of the present invention.

The preferred embodiment of the deployable anti-terrorist barricade unit 10 of the present invention is shown in extended position in FIG. 2. The barricade unit 10 employs an elongate rigid post 12, such as a length of railroad track, which is received in an elongate hollow casing 14, such as a section of pipe or tubing, preferably closed at the bottom 16 and open at the top. A pair of circular guide plates 18*a* and 18*b*, having a diameter slightly smaller than the inner diameter of the casing, are welded or otherwise securely fixed to the post. The guide plates are fixed to the post in a spaced-apart configuration, the lower guide plate 18*a* located proximate the lower end of the post and the upper guide plate 18*b* preferably spaced more than one-half the post length above the lower guide plate. A circumferential band 20 is centered on and fixed to the outer circumference of each guide plate immediately adjacent the inner wall of the casing.

Figure 3:
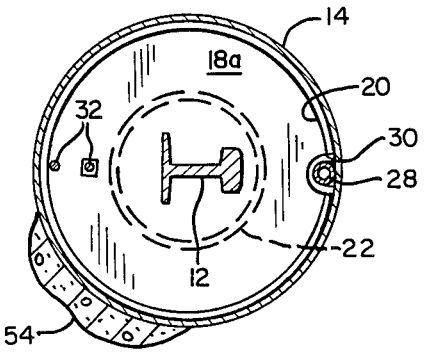
FIG. 3 is a sectional plan view of the barricade unit of FIG. 2 taken along line 3—3.

A compression coil spring 22 is positioned in the bottom 16 of the casing and is interposed between the casing and the underside of the lower guide plate. The barricade unit also includes a locking arm 24 and a trigger mechanism 26 for locking and releasing the locking arm. A length of small diameter pipe 28 extends from top to bottom of the casing and is fixed to the inside of the casing. Guide plates 18*a* and 18*b* and their respective circumferential bands 20 each include a notch 30, as may be seen in FIG. 3, to permit the pipe to extend past the guide plates along the inner wall of the casing. The pipe 28, in addition to the guiding function explained below, may be used as a conduit to remove water from the bottom of the casing. A cable 32, preferably stainless steel, is fastened to the the lower guide plate 18*a* and passes downwardly toward the bottom 16 of the casing where it is passed through a pulley 34 anchored in the bottom of the casing, then passed upwardly through apertures in the lower and upper guide plates, respectively. The barricade unit preferably includes a cover 38 hinged to the upper edge of the casing to cover the open top of the casing. The entire barricade unit, except for electrical parts, which should be waterproof or moisture resistant, is preferably coated with a coal tar epoxy or other protective coating to resist corrosion.

The post 12 has a retracted position within the casing shown in dashed lines in FIG. 2. In the retracted position the spring 22 is compressed and the locking arm 24 abuts a cocking lug 40 on the upper portion of the post to selectively prevent the spring from forcing the post up and out of the casing. The trigger mechanism 26 holds the locking arm in place. In the retracted position, the cover 38 is allowed to seat on the open upper end of the casing, covering the casing and the post. A relatively weak biasing spring, not shown, may be used to urge the cover down over the casing. The trigger mechanism may be covered with a removable access plate 58 so that the trigger mechanism may be periodically serviced while the barricade unit is in place.

To deploy the barricade unit in the extended position shown in FIG. 2, the trigger mechanism 26 is activated, allowing the locking arm 24 to be pivoted up and out of the way by the force of the compressed coil spring rapidly pushing the post out of the casing. A stop 42 welded or otherwise fixed to the inner wall of the casing near its top prevents the post from extending completely out of the casing and permits only a preselected portion 44 of the post to protrude from the casing by preventing the upper guide plate 18*b* from passing the stop. The post is prevented from rotating about its longitudinal axis by the interaction of the pipe 28 welded to the inner wall of the casing and the notches 30 in the guide plates. The hinged cover, having no catch, swings up and out of the way when the post is forced out of the casing by the powerful spring.

The cable 32 may be used to reinstall the post in its retracted position by application of sufficient upward tension to the free end 45 of the cable 32 to overcome the force of the compression spring. When the post has been retracted, the locking arm may be repositioned and trigger mechanism reset so that the barricade unit is again ready for instantaneous use.

The barricade unit of the present invention may be easily installed by digging a hole in a roadway and positioning the already-assembled barricade unit in the hole so that the top of the casing is substantially flush with the surface of the roadway. To securely fix the barricade unit in position, it is preferable to set the casing in concrete 54, although compacted earth surrounding the casing will suffice where concrete is not available. Although the preferred installation of the barricade unit of the present invention is in a submerged position below grade in a roadway as explained above, the barricade unit may also be installed in a horizontal orientation, imbedded in a road bank or a structure adjacent the roadway.

In its extended position, the barricade unit of the present invention is capable of stopping the passage of heavy vehicles including tracked vehicles. The impact of a vehicle striking the preselected portion 44 of the post extending above the ground is resisted by the widely spaced guide plates 18*a* and 18*b* which bear against the adjacent portions of the casing. The force of the impact is distributed to the casing wall by the wide circumferential bands 20 attached to the guide plates and thereafter distributed to the surrounding concrete 54 by the casing wall. As shown in FIG. 2, an impact, represented by force arrow A, will be transmitted to the casing by guide plates 18*b* and 18*a* and their respective circumferential bands 20 and resisted by the casing and the surrounding concrete in a manner represented by the plurality of force arrows B and C. In such a fashion the barricade unit can absorb and resist an enormous point impact by spreading the reactive forces over a large section of the casing and into the concrete or compacted earth surrounding the casing. The preselected portion 44 of the post extending above the ground is preferably less than one-half of the length of the post to ensure that the reactive forces C act at a greater moment arm from the pivot point, located at the upper guide plate, than does the impact force A. As shown in FIG. 2, the barricade unit is canted slightly toward the projected impact to convert and absorb some of the impact in an axial manner.

The barricade unit may be reused after impact by reinstalling it in a retracted position as described above. In a subterranean installation, such as shown in FIG. 2, a fork lift, winch, or other hand or power equipment may be used to pull the retraction cable 32 upwardly and overcome the resistance of the coil spring. For example, a small hand powered winch on wheels could be supplied with each installation to draw the post back into the casing. If the post or guide plates have been bent or damaged it is a simple matter to remove the stop 42 and pull out the bent post, allowing the free end 45 of the cable to pass through the apertures in the guide plates. A new post may be inserted into the casing and the stop 42 replaced on the casing wall. In the interim, the cover 38 will permit traffic to pass over the empty casing and prevent observers from ascertaining that the post has been removed and that the casing is empty.

Figure 1:
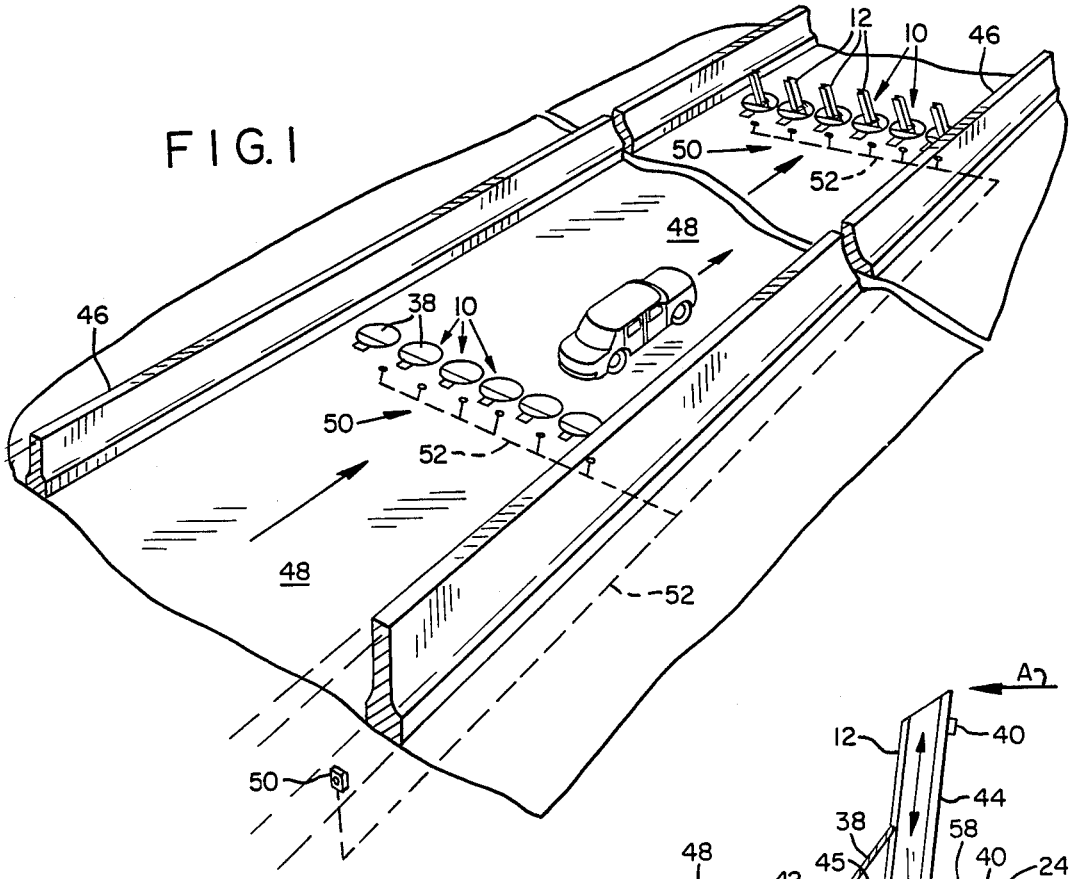
FIG. 1 is a perspective view of the barricade system of the present invention employing a plurality of barricade units.

As shown in FIG. 1, a preferred installation of barricade units includes lateral barriers 46 lining the sides of the roadway 48 to be protected so as to prevent vehicular movement onto and off of the roadway from areas adjacent to the roadway, but permit free vehicular movement along the roadway. An array 50 of barricade units 10 are installed extending across the roadway between the barriers 46. As explained above, the barricade units are installed substantially beneath the roadway so that with their respective posts in the retracted position, and with their respective covers 38 down, the barricade units allow vehicular traffic to pass directly over them without impediment. Although FIG. 1 shows a group of barricade units extending in a straight line across the roadway between the barriers, it will be appreciated that any grouping which would prevent vehicular traffic from passing the array 50 would be appropriate.

As set forth above, each of the barricade units includes a trigger mechanism 26 for releasing the locking arm and allowing the spring 22 to push the post partially out of the casing. The trigger mechanism shown in FIG. 2 is a DC electric solenoid, however, alternative trigger mechanisms such as AC solenoids, hydraulic pistons, or the like, may be employed through a variety of linkages or sear devices to release the locking arm. The configuration shown in FIG. 2 also employs a snubber spring 56 to prevent accidental release of the trigger mechanism.

A combination of triggering arrangements may be used. For example, if an AC solenoid is employed, an automatic transfer switch could be used to switch the solenoid to a battery powered DC operation in case of interruption of the AC power. Alternatively, an electrical triggering circuit could be devised to deploy the post in the event all power is cut off from the device.

As shown in FIG. 1, the barricade system includes a network of control lines 52 such as electrical wires which allow the trigger mechanisms of the individual barricade units to be activated from a control switch 52 located at one or more remote locations. Alternatively, the trigger mechanisms could respectively include a receiver which allows them to be activated in response to a transmitted signal of a predetermined frequency or wave form. In the embodiment shown in FIG. 1, it is preferable that the control system activate all barricade units 10 of an array 50 substantially simultaneously and that electrical connections between the individual barricade units of an array are in parallel so that a malfunction of one barricade unit does not prevent the remainder of the units in the array from deploying.

It is contemplated that a plurality of arrays 50 may be installed along a length of the roadway so that prevention of a terrorist attack does not depend upon the deployment of one array of barricade units. In addition, a plurality of barricade arrays may be employed to isolate and trap the terrorists between forward and rearward arrays of deployed barricade units and the lateral barriers. This may be accomplished by allowing the terrorists to pass the first array prior to simultaneously deploying a plurality of barricade arrays, or by having a separate control system for each barricade array so that each array can be selectively deployed in response to the position of the terrorists. Alternative control systems are envisioned, such as having several remote locations which can selectively control any or all of the barricade arrays.

In the situation described above, with the terrorist vehicle caught between two deployed arrays of barricade units in the front and rear, and between the barriers 46 on either side, damage from an explosion would be limited, the barriers tending to deflect the blast upwardly. Because the barricade units, except for their posts, are encased in concrete below grade, it is unlikely that the barricade units, except for the post, will be damaged by such a blast.

The barricade system and barricade units described above can be fabricated and assembled at the manufacturing plant, flown anywhere in the world, and, once on location, installed in compacted earth in a matter of hours. Installation in concrete would be limited only by the time required to allow the concrete to cure. For example, to install an array 50, as shown in FIG. 1, a backhoe could be used to dig a trench across a roadway, and the barricade units set in the trench spaced close enough to adjacent units to prohibit vehicular passage between adjacent units. A barricade system such as described above can allow unimpeded vehicular traffic to a military base or embassy, yet be capable of being deployed instantaneously in a matter of seconds from a variety of remote locations. Such a system would have prevented the attack on the U.S. Marine Headquarters in Beruit in October 1983 and the subsequent September 1984 attack on the American Embassy in Beruit.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A deployable vehicle barricade apparatus for resisting and absorbing vehicular impact comprising:

(a) an elongate rigid post having two ends, a top end and bottom end;

(b) elongate rigid tubular casing means for receiving said post, said casing means having an inner surface and an outer surface;

(c) propellant means for rapidly causing an upper portion of said post proximate said top end to extend beyond said casing means;

(d) brace means cooperating between said post and said inner surface of said tubular casing means for resisting and transferring the force of a vehicular impact upon said upper portion of said post to said casing means; and (e) said brace means including at least two spaced-apart brace elements, each of said brace elements cooperating between said post and said inner surface of said casing means to transfer said force to said casing means, said brace elements spaced apart a distance greater than one-half the length of said post.

2. The barricade apparatus of claim 1 wherein said brace means include guide means cooperating between said post and said casing means for permitting said post to move axially with respect to said casing means.

3. The barricade apparatus of claim 1 wherein at least one of said brace elements is arranged proximate said bottom end of said post.

4. The barricade apparatus of claim 1 wherein one of said brace elements is uppermost, said brace elements being spaced apart a distance greater than the distance between said uppermost brace element and said top end of said post.

5. The barricade apparatus of claim 1 wherein said brace means include omni-directional means for resisting said force and transferring said force to said casing means when said force is applied to said upper portion of said post from substantially any direction which is substantially perpendicular to said post.

6. The barricade apparatus of claim 1 wherein said brace means include means for distributing said force throughout a predetermined surface area of said inner surface of said casing means.

7. The barricade apparatus of claim 1 wherein said upper portion of said post which extends beyond said casing means is equal to or less than one-half the length of said post.

8. The barricade apparatus of claim 1 including mass means adjacent said outer surface of said casing means and cooperating with said casing means for absorbing and resisting said force.

9. The barricade apparatus of claim 8 wherein said mass means includes concrete surrounding said casing means.

* * * * *